US006540400B2

(12) United States Patent
Gross et al.

(10) Patent No.: US 6,540,400 B2
(45) Date of Patent: Apr. 1, 2003

(54) CAP FOR BAG

(75) Inventors: Joan Gross, Augsburg (DE); Herbert Ginter, Kaufbeuren (DE); Roland Sieber, Landsberg (DE)

(73) Assignee: Hilti Aktiengesellscgaft, Schaan (LI)

( * ) Notice: Subject to any disclaimer, the term of this patent is extended or adjusted under 35 U.S.C. 154(b) by 112 days.

(21) Appl. No.: 09/792,441

(22) Filed: Feb. 23, 2001

(65) Prior Publication Data

US 2001/0017948 A1 Aug. 30, 2001

(30) Foreign Application Priority Data

Feb. 26, 2000 (DE) ..... 100 09 265

(51) Int. Cl.[7] ..... B65D 33/16
(52) U.S. Cl. ..... 383/80; 383/71
(58) Field of Search ..... 383/70, 71, 80; 215/348, 392, 394, 41; 206/204

(56) References Cited

U.S. PATENT DOCUMENTS 2,102,702 A * 12/1937 Hall ..... 383/80 X
2,682,903 A * 7/1954 Gay ..... 383/80 X
3,317,119 A * 5/1967 Lasoff ..... 383/70
3,612,325 A * 10/1971 Williams ..... 215/350 X
5,381,914 A * 1/1995 Koyama et al. ..... 215/348 X

* cited by examiner

*Primary Examiner*—Jes F. Pascua
(74) *Attorney, Agent, or Firm*—Sidley Austin Brown & Wood, LLP

(57) ABSTRACT

A bag (1) for a one-component or two-component composition containing liquid is gathered at least at one end by a clip (2) into a pleated closure (3). In the region of the pleated closure (3), an absorbent (4) is disposed in order to prevent the uncontrolled flow of liquid from the bag (1).

6 Claims, 1 Drawing Sheet

CAP FOR BAG

FIELD OF INVENTION

Figure 1:
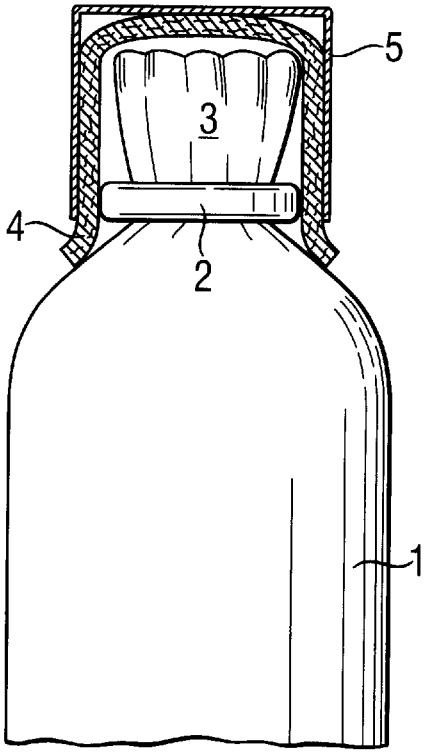

The invention relates to a bag for one-component or two-component compositions containing a liquid having at least one open end gathered together into a pleated closure and closed off with a clip.

BACKGROUND INFORMATION AND PRIOR ART

Many materials, such as sealing materials and adhesives, are filled into bags at the present time. The bags are closed off with wire or a prefabricated clip. The materials are, for example, one-component or two-component compositions, such as polyurethane systems, silicone compositions, injection composite mortars and the like. Depending on the materials contained and the physical behavior of the liquid content of the compositions filled into the bags, leaks may occur at the open ends of the bags gathered together in pleated closures. These leaks are caused when the liquid components separate from the other materials, filled into the bag, and flow from the bag through the folds of the bag in the region of the clip, intensified by capillary action. Such effect can be amplified even more by filling the bag with coarse materials.

Methods are known, which are intended to seal the bag by additional measures, such as welding or additional sealants. A bag of the type mentioned is known in DE 29809514 U1. In the region of the pleated closure, the bag has a sealing film, which consists, for example, of wax, adhesive or the like. However, a disadvantage of this known solution is that the liquid is not stopped from emerging in the region of the pleated closure, since the sealants generally do not achieve any adhesive action with the surface of the bag.

Furthermore, a bag is disclosed in CH 277854, where the pleated closure is welded. It is a disadvantage of this known solution that, in the event the material filled into the bag, is in the region where the welded seam is to be produced, the bag may leak.

OBJECT OF THE INVENTION

It is an object of the present invention to prevent an uncontrolled flow of liquid from bags having at least one end gathered together into a pleated closure.

SUMMARY OF THE INVENTION

In accordance with the invention, the object is accomplished owing to the fact that an absorbent for the liquid is disposed at least partially in the region of the pleated closure.

Owing to the fact that the emerging liquid is collected with the help of an absorbent in the region of the pleated closure, the uncontrolled flow into the region surrounding the bag closure and, especially, a contamination of the surface of the bag can be avoided. In addition, this arrangement also avoids an uncontrolled passage of liquid from the bag in the region of the clip. In this region, the bag can be damaged by filling material in the region of the clip, in such a manner that leakages occur there. The emerging liquid is taken up or bound immediately by the absorbent by chemical or physical means in the region of the pleated closure.

Advisably, at least at the internal periphery of the bag, the pleated closure has an absorbent for liquid, in order to take up immediately any liquid flowing out at the gathered end of the bag. In addition, the possibility exists of disposing the absorbent in the free end itself; in this way, it is protected largely by the pleated closure from external effects.

Advantageously, the pleated closure has an absorbent for liquid, at least partially at the outer periphery of the bag. By means of this arrangement, the uncontrolled emergence of liquid along the outer periphery of the bag in the region of the pleated closure is avoided.

Preferably, the absorbent is disposed at the free open end of the pleated closure. Accordingly, the liquid, flowing from the bag, can be absorbed at the free end of the pleated closure. From a manufacturing point of view, the absorbent can be mounted easily at the free open end of the pleated closure, so that the manufacturing process is economical. Furthermore, for this embodiment, little absorbent is required.

The absorbent advisably is provided in the form of a cap, at least partially embracing the pleated closure radially outwardly and at the free open end. This one-part absorbent, which can be manufactured easily, represents an optimum solution for absorbing liquid, which emerges from any region of the pleated closure, and thus for keeping the region surrounding the pleated closure free from the liquid.

Furthermore, advantageously the absorbing material is disposed on the inside of a cap, enclosing the pleated closure at the free open end as well as radially outwardly. Accordingly, the absorbent is protected from external effects.

Preferably, the absorbent is formed from an absorptive material. Accordingly, it is possible to produce the absorbent from a material, which can easily be attached to the bag. As the absorbent, highly absorptive materials known from other applications can be used.

If the absorbing material is an absorbing nonwoven material, especially a felt, the bag can be manufactured economically and is easily handled by the user.

If the absorbent consists of a material, which reacts chemically with the emerging liquid, the liquid absorbed is bound chemically and contamination of the surrounding environment is prevented. The chemical material is to be selected so that, after the reaction with the liquid, a material is formed which no longer is flowable, especially a solid or a highly viscous material. This embodiment is optimum, especially for aggressive liquids and/or for liquids, the handling of which is unpleasant.

Preferably, the chemically reacting material is a polyacrylic acid copolymer or a polyacrylate, which has been provided with epoxide groups for the absorbent. By such means, an economic manufacture of the bag is ensured.

DETAILED DESCRIPTION OF THE DRAWING

The invention is described in greater detail as follows. In the drawing

Figure 2:
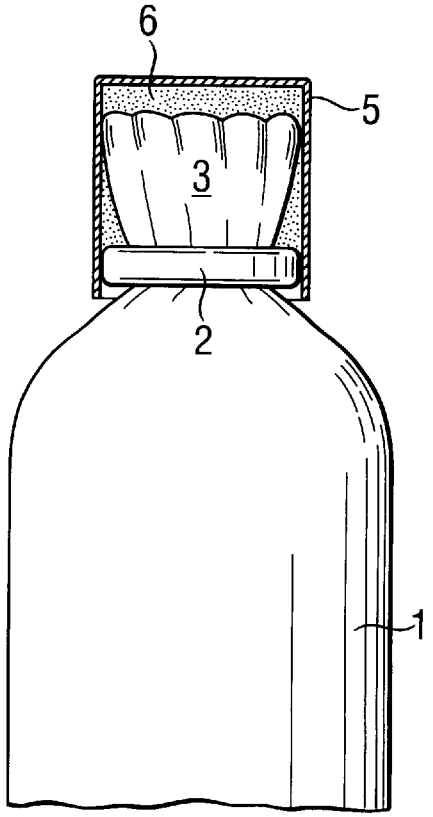

FIG. 1 shows in part a bag with a cap-shaped absorbent of a nonwoven material, and FIG. 2 shows a part of a bag similar to FIG. 1 with a chemical absorbent.

DETAILED DESCRIPTION OF THE INVENTION

The bag 1 of the present invention, shown in FIGS. 1 and 2, is closed off at the open end with a metal clip 2, so that a pleated closure 3 is formed. In the region of the pleated closure 3, an absorbent is provided, which is cap-shaped and embraces the pleated closure radially outwardly and at the free open end over the whole of its periphery.

In FIG. 1, the absorbent is formed from a cap of an absorptive nonwoven material 4 enclosed by an outer cap 5.

The embodiment, shown in FIG. 2, uses a material 6 as absorbent, which reacts chemically with the emerging liquid. As in FIG. 1, the absorbent is enclosed by an outer cap 5.

In FIGS. 1 and 2 the absorbent is located within the cap 5 so that the absorbent 4, 6 is enclosed radially outwardly and across the free open end of the bag 1.

What is claimed is:

1. A bag (1) for at least a one-component composition containing a liquid, said bag (1) having at least one open end, said open end gathered into a pleated closure (3), a clip (2) closing the pleated closure and an absorbent for liquid flowing out of the region of the pleated closure said bag has an outer periphery of said pleated closure (3) and said absorbent is located at the outer periphery of said pleated closure (3), said absorbent is cap-shaped and at least partially encloses said absorbent at said open end and radially outwardly of said pleated closure.

2. A bag, as set forth in claim 1, wherein said absorbent is an absorbing material.

3. A bag, as set forth in claim 2, wherein said absorbing material is an absorbing non-woven material.

4. A bag, as set forth in claim 3, wherein said absorbing non-woven material is a felt pad.

5. A bag, as set forth in claim 2, wherein said absorbing material is a material reacting chemically with the liquid.

6. A bag, as set forth in claim 5, wherein said absorbing material comprises of polyacrylic acid copolymer.

* * * * *